United States Patent [19]

Larson et al.

[11] 3,965,669

[45] June 29, 1976

[54] ENGINE RUNNING TIME INDICATOR

[75] Inventors: Gerald L. Larson; Roger F. Kuether, both of Battle Creek, Mich.

[73] Assignee: Eaton Corporation, Cleveland, Ohio

[22] Filed: Feb. 18, 1975

[21] Appl. No.: 550,509

[52] U.S. Cl. ..... 58/146; 58/39.5

[51] Int. Cl.[2] ..... G07C 3/02; G04F 8/00

[58] Field of Search ..... 58/39.5, 145–147; 73/116; 235/104; 340/309.1–309.4, 263

[56] References Cited

UNITED STATES PATENTS

| | | | |
|---|---|---|---|
| 2,660,057 | 11/1953 | Ackley | 58/145 R |
| 3,854,281 | 12/1974 | Reichert | 58/39.5 |

*Primary Examiner*—Edith Simmons Jackson
*Attorney, Agent, or Firm*—Teagno & Toddy

[57] ABSTRACT

A cumulative running time indicator for use with an engine has a ceramic resonator-controlled oscillator that drives an electronic divider, a multiplexer, and a stepping motor which is connected through a gear train to a mechanical display showing elapsed time. The running time indicator operates only when an electrical generator, which is mechanically coupled with the engine, produces sufficient voltage to operate the indicator circuits. Sufficient voltage is produced at all engine speeds above a threshold speed which is less than engine idling speed. The generator supplies ac voltage to doubler circuit that has two separate outputs — one for supplying large pulses of current for the stepping motor, and a partially isolated second output for other electronic loads. A tachometer output signal is provided at an auxiliary output terminal and is buffered to prevent disablement of the running time indicator by short circuits and externally applied voltages at the auxiliary output terminal. The running time indicator is therefore self-powered, relatively secure from tampering, and accurate.

17 Claims, 13 Drawing Figures

ENGINE RUNNING TIME INDICATOR

BACKGROUND OF THE INVENTION

The present invention relates to apparatus for indicating the accumulated running time of engines. For example, an internal combustion engine for powering a tractor is ordinarily operated intermittently, and it is often desired for purposes of maintenance or of warranty validation to maintain an accurate indication of the cumulative amount of time that the engine has been operated since it was initially put into service. When a running time meter is intentionally disabled, it is difficult to estimate whether it was disabled recently or many running hours earlier. A need has been felt for a running time indicator that is difficult to disable accidentally or to disable intentionally in such a way as to give an appearance that the running time indicator became defective unintentionally, and for a running time indicator that is self-powered and which retains ts accumulated total despite a power interruption.

SUMMARY OF THE INVENTION

The present invention is a tamper-resistant and accurate indicator of engine running time. In one specific form of the invention an electronic oscillator whose frequency is controlled by a ceramic resonator provides a periodic signal to an electronic frequency divider. The frequency of the output signal of the frequency divider is employed in a multiplexer and a signal steering circuit to drive the coils of a stepping motor. The shaft of the stepping motor is geared to a mechanical registering indicator, which indicates the cumulative running time of the electronic oscillator. The oscillator runs whenever the engine runs, because electrical power for the entire running time indicator apparatus is derived from a small electrical generator that is mechanically coupled with the engine.

In one aspect of the invention, a cumulative running time indicator is provided whose electrical power requirements are supplied entirely by a separate generator which is a portion of the running time indicator. The generator provides sufficient power to operate the running time indicator when the speed of the engine exceeds a threshold speed which is less than the idle speed of the engine. Consequently, the running time indicator is turned on and off by means of its own speed-responsive power supply.

In another aspect of the invention, security from intentional and unintentional tampering is provided by mounting the separate generator at the input end of an armored electrical cable whose other end connects with a mechanically sealed enclosure that houses an electronic indicator circuit.

In a further aspect of the invention, a very accurate indication of running time is insured by employing a ceramic resonator in an electronic oscillator that sets the pace of the display.

In still another aspect of the invention, a stepping motor, which is advanced by pulses at uniform time intervals established by the electronic oscillator, has its output shaft connected to drive a cumulative time display device. Logic circuits are employed for steering successive pulses that are derived from the clock to different coils in turn of the stepping motor.

Yet another aspect of the invention concerns the power supply. As ac generator is employed having considerable internal inductance as well as resistance. Because the generator is an ac and not a dc type, the internal inductive voltage drop is higher at relatively high generator speeds than at low speeds, due to the relatively higher generated frequency. Consequently, the generated voltage does not vary as widely as the engine speed varies, and no voltage regulator is required.

With further regard to the power supply, the stepping motor requires high-power pulses of low duty cycle, e.g. less than 20% duty cycle, for its operation. A voltage doubler circuit is employed in which the voltage doubler capacitors perform at least two functions, namely (a) doubling the voltage, and (b) converting a low power, which is relatively uniformly generated by the generator, to high-power pulses of low duty cycle for operating the stepping motor.

A related aspect of the power supply portion of the invention involves providing a relatively uniform power supply voltage for energizing certain portions of the running time indicator, buffered from extreme voltage reductions that the pulse loads of the stepping motor impose upon the power supply, and providing this relatively uniform voltage without incurring the energy dissipation ordinarily entailed in a conventional regulator.

In yet another aspect of the invention, an auxiliary output signal is provided at an auxiliary output terminal for connection with an engine speed indicator, and deliberate efforts to disable the entire runnin time indicator by short circuiting the auxiliary output terminal or by applying external voltages to it ar frustrated. Internal circuits for providing the auxiliary output signal are such as to protect the running time indication portion of the apparatus from such improper connections.

Another aspect of the invention is to combining of apparatus for providing the engine auxiliary speed indicator signal with the running time indicator, in which a generator employed for self-powering the running time indicator and therefore for turning it on and off, also provides the engine auxiliary speed indication signal.

Other aspects and features of the invention are brought out in the accompanying description of the preferred embodiment, claims, and figures.

DESCRIPTION OF A PREFERRED EMBODIMENT

Figure 1:
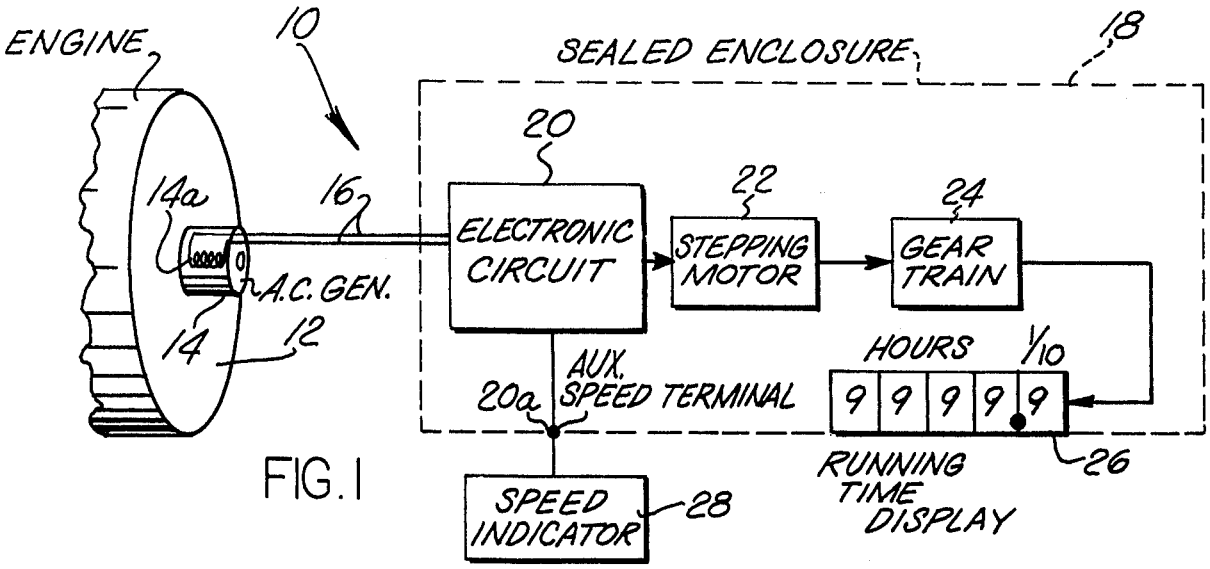
FIG. 1 is a block diagram showing major components of a preferred embodiment of the running time indicator.

A preferred embodient 10 of the cumulative running time indicator is attached to a transmission portion of an engine 12, as shown in FIG. 1. The running time indicator 10 includes a permanent magnet ac generator 14 whose rotor is driven by a rotating transmission component of the engine 12. An electrical output signal from the tachometer 14 is conducted by an armored cable 16 to a mechanically sealed enclosure 18, which is mounted in a convenient place remote from the engine 12. The sealed enclosure 18 encloses various components including an electronic circuit 20 and a stepping motor 22 whose rotor is turned by the electronic circuit 20. The stepping motor 22 drives a gear train 24 whose output torque rotates an input shaft of a running time display device 26. In the present embodiment the running time display device 26 is a mechanical register that displays a series of numerals which form a number signifying the cumulative number of hours and tenths of hours that the engine 12 has been operated, starting from a time when the register 26 indicated zero.

The electronic circuit 20 also applies an auxiliary periodic signal, having a frequency proportional to the speed of the engine 12, to an auxiliary output terminal 20*a* of the enclosure 18. An optional and external speed indicator 28 is connected to the auxiliary speed signal terminal 20*a* to produce a display of the engine speed.

Figure 2:
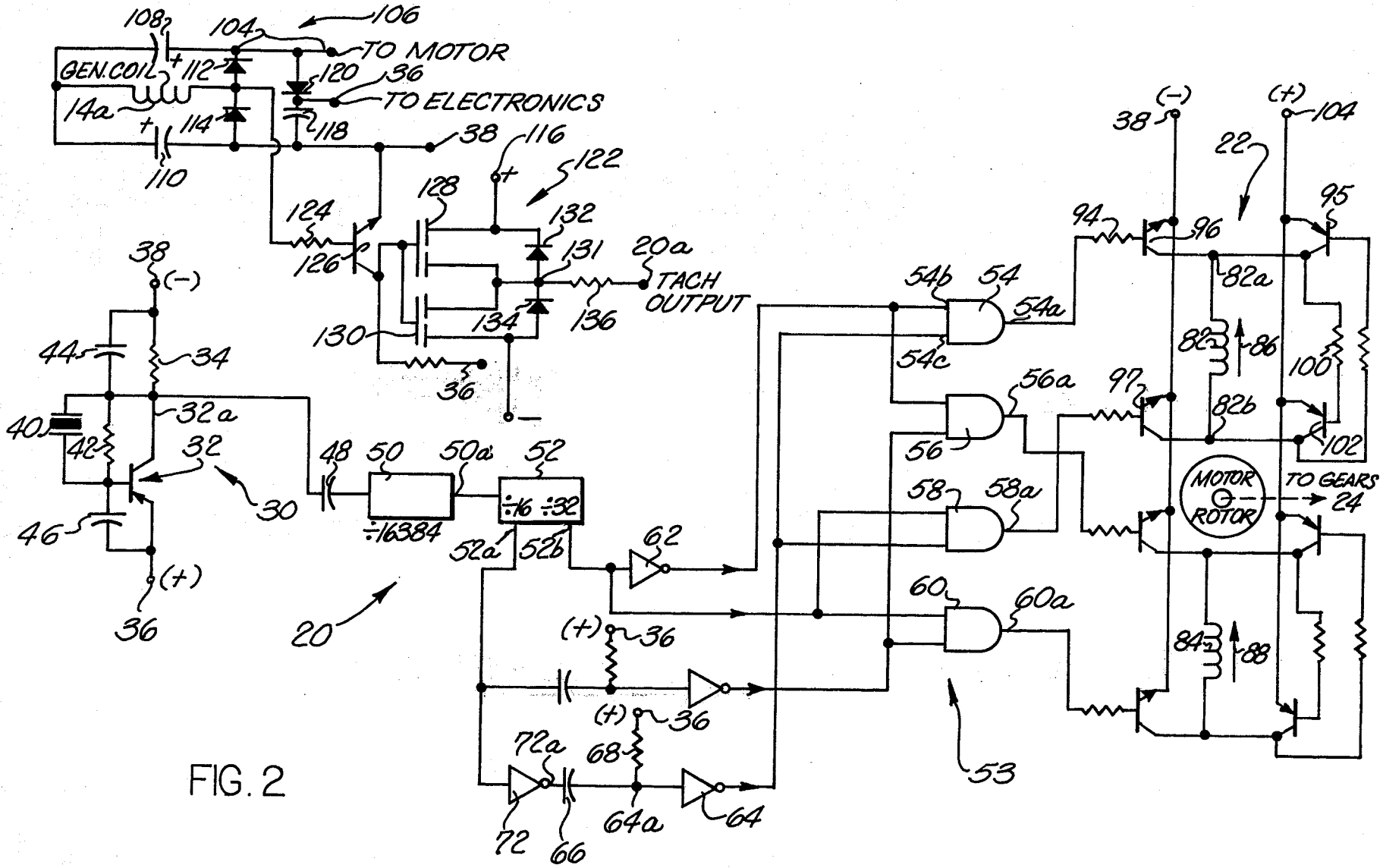
FIG. 2 is an electrical schematic circuit diagram of the running time indicator of FIG. 1.

The electronic circuits 20 of the running time indicator 10 includes an oscillator 30 that produces periodic signals at a constant frequency to control the rate at which the stepping motor 22 is rortationally advanced, see FIG. 2. The frequency of the oscillator 30 is precisely controlled preferaly at 209.7 KHz by a ceramic resonator 40. The oscillator circuit 30 is conventional when standing alone, and includes an amplifier transistor 32 having its emitter-collector circuit connected in series with a load resistor 34 between positive and negative voltage supply terminals 36, 38, respectively. A resistor 42 for biasing a base 32*b* of the transistor 32, and capacitors 44, 46 for conducting ac components of signal, are included in the oscillator. A portion of periodic signal power at a collector 32*a* of the transistor 32 is fed back through the ceramic resonator 40 to the base 32*b* to sustain oscillation.

An output component of periodic signal power produced by the oscillator 30 is conducted from the collector 32*a* through a coupling capacitor 48 to a binary 14-stage frequency divider 50 of conventional design, where the oscillator's frequency is divided by a factor of 16,384. From an output terminal 50*a* of the frequency divider 50 a square wave signal is connected to a pulse input terminal of another frequency divider 52, which has both a divide-by-16 output terminal 52*a* and a divide-by-32 output terminal 52*b*.

Figure 3A:
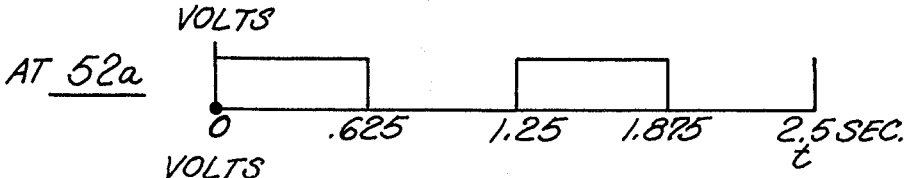
FIGS. 3*a*, through 3*h* illustrate voltage waveforms in the running time indicator for distributing electrical pulses to coils of a stepping motor in the device.
Figure 3B:
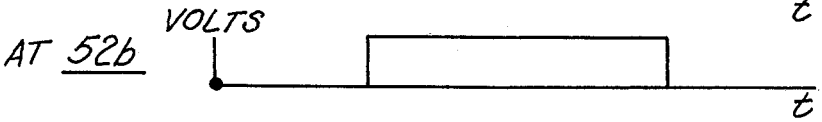
Figure 3C:
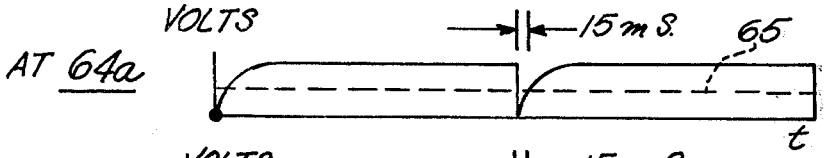
Figure 3D:
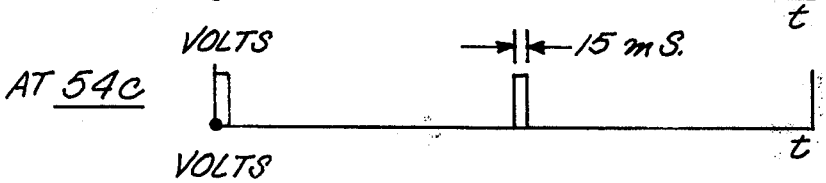
Figure 3E:
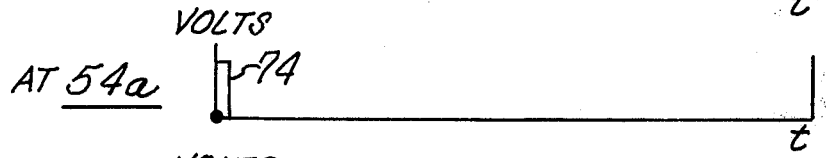

The two output signals of differing frequency at the terminals 52*a*, 52*b* are shown in FIGS. 3*a* and 3*b* respectively. They are used by logic circuits 53 to produce pulses 74, 76, 78, 80, FIGS. 3*e*–3*h* in time succession at four different control terminals 54*a*, 56*a*, 58*a*, 60*a* for controlling the stepping motor 22. The positive 15 millisecond pulse 74 of FIG. 3*e* is produced at the output terminal 54*a* of an AND gate 54 when logic 1 input signals are simultaneously present on two input terminals 54*b* and 54*c* of the AND gate 54. The manner in which these two input signals are produced will now be described. A logic 1 signal is produced at the terminal 54*b* merely by inverting the logic input signal of the divider terminal 52*b* in an inverter 62. The other terminal 54*c* of the AND gate 52 is provided with a 15 millisecond logic 1 pulse as follows.

The frequency divider terminal 52*a* has a square wave logic signal alternating between logic 1 and logic 0 levels at a frequency of 0.8 Hz, as shown in FIG. 3*a*. This signal is inverted by an inverter 72, whose output is applied to a differentiating circuit consisting of a series-connected capacitor 66 and a resistor 68. The resistor 68 is connected from a junction 64*a* of the capacitor 66 to a positive voltage supply terminal 36, and therefore maintains a logic 1 signal at the junction 64*a* when no differentiation is occurring. The junction 64*a* is connected to the input of another inverter 64. Upon each transition of the signal from a logic 1 level to a logic 0 level at the output of the inverter 72, a logic 0 pulse is transiently produced at the junction 64*a* by the differentiating network 66, 68. This logic 0 pulse is below a threshold 65 of the inverter 64 for about 15 milliseconds, as shown in FIG. 3*c*. The 15 millisecond portion of the pulse is inverted by the inverter 64, to a logic 1 pulse, and that logic 1 pulse is connected to the input terminal 54*c* of the AND gate 54.

Alternate ones of the 15 millisecond pulses at the input terminal 54*c* occur while the other input terminal 54*b* has a logic 1 signal, so that a logic 1 control pulse 74 is produced once each 2.5 second at the output terminal 54*a* of the AND gate 54, as shown in FIG. 3*e*.

Figure 3F:
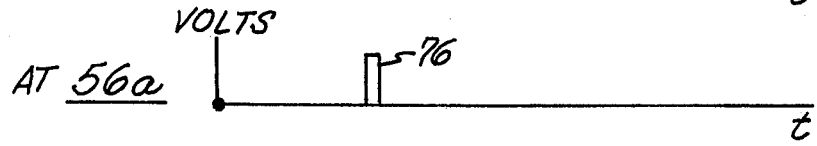
Figure 3G:
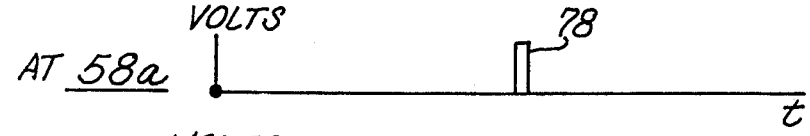
Figure 3H:
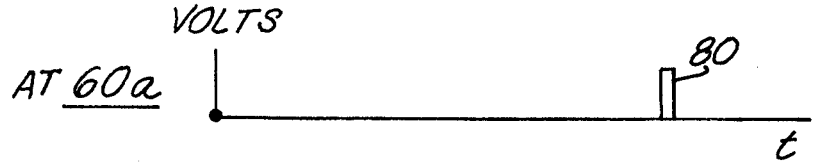

In a similar manner, other AND gates 56, 58 and 60 produce control pulses 76, 78 and 80 at their output terminals 56*a*, 58*a*, 60*a*, respectively as shown in FIGs. 3*f*, 3*g* and 3*h*. The period of the pulses 76, 78, 80 is also 2.5 seconds, and the pulses are out of phase by ¼ cycle, the pulse 76 occurring 0.625 second after the pulse 74, etc. Thus the logic circuit 53 cooperates with the counter 52 to produce four-phase clock pulses that occur in succession on the four control terminals 54*a*, 56*a*, 58*a* and 60*a*.

The stepping motor 22 is a conventional two-phase type having two stator coils 82 and 84, the coil 84 being angularly displaced in the stator from the coil 82. The control pulse 74 of FIG. 3*e* drives switching transistors 96, 102, that cause a powerful current pulse in the coil 82 in a direction indicated by an arrow 86, FIG. 2.

The logic 1 pulse 74 is applied through a series resistor 94 to the base of the NPN steering transistor 96, whose collector-to-emitter circuit is connected in series from a first terminal 82*a* of the coil 82 to the negative terminal 38 of a power supply. The collector electrode of the transistor 96 is connected also through a series resistor 100 to a base electrode of the PNP switching transistor 102. The pulse 74 results in a down-going voltage pulse at the base of the transistor 102, which renders the emitter-to-collector circuit of the transistor 102 conductive, so as to connect a second terminal 82*b* of the motor coil 82 to a positive terminal 104 of the power supply. In this way, the control pulse 74 results in a powerful current pulse of about 15 millisecond duration from the positive supply terminal 104 through the transistor 102, through the coil 82 in the direction 86 and through the transistor 96 to the negative supply terminal 38. This current pulse turns the motor 22.

In a similar manner, each of the pulses 76, 78, 80, results in a powerful current pulse through one of the motor coils 82 and 84 to operate the stepping motor.

The control pulse 76 controls a powerful current pulse in the coil 84 in a direction indicated by an arrow 88, and turns the rotor slightly. Similarly, the control pulse 78 produces a current pulse in the coil 82 in a direction opposite that shown by the arrow 86, and the control pulse 80 results in a current pulse in the coil 84 in a direction opposite that indicated by the arrow 88. Each complete 2.5 second cycle of the motor drive waveforms shown in FIG. 3*e* to 3*h* results in an angular advancement of 1/12 revolution of the rotor of the stepping motor 22.

The speed at the shaft of the stepping motor 22 is reduced by a factor of 3600 by the gear train 24, whose output shaft is connected to the register 26 to display the cumulative number of hours that the engine has been operated.

The oscillator 30 and other portions of the running time indicator operate only when they are energized by power from a power supply 106, one of whose elements is the ac generator 14. The power supply 106 also includes a voltage doubler, and has two separate outputs. The generator 14 has a permanent magnet rotor and an electromagnetic stator coil 14*a*, shown in FIG. 2. An equivalent electrical circuit of the stator coil 14*a* is an idealized ac generator in series with an internal resistance and a self-inductance of the coil 14*a*.

One terminal of the generator coil 14*a* is connected to the anode of a diode 112, whose cathode is connected to a capacitor 108. The other terminal of the capacitor 108 is connected to a second terminal of the generator coil 14*a*. The junction 104 of diode 112 and capacitor 108 is a first output terminal of the power supply 106. In a similar manner a diode 114 and a capacitor 110 are series-connected with the generator coil 14*a*, except with the polarity of the diode 114 opposite that of the diode 112. The junction 38 of diode 114 and capacitor 110 is a common negative output terminal of the power supply 106. The diodes 112, 114 and the capacitors 108, 110 constitute the voltage doubler circuit.

When the diode end of the generator coil 14*a* has a positive generated voltage, the diode 112 conducts to charge the capacitor 108 with a positive voltage at the first positive output terminal 104. The next half cycle of voltage generated in the generator coil 14*a* is of opposite polarity from the first and the diode 114 conducts current to charge the capacitor 110 with a negative charge at the junction of the negative output terminal 38. The previously produced positive charge on the capacitor 108 adds in series with the voltage of the capacitor 110 to produce a voltage between the terminals 104, 38 whose value approaches the peak-to-peak value of ac voltage generated by the coil 14*a*.

Figure 4A:
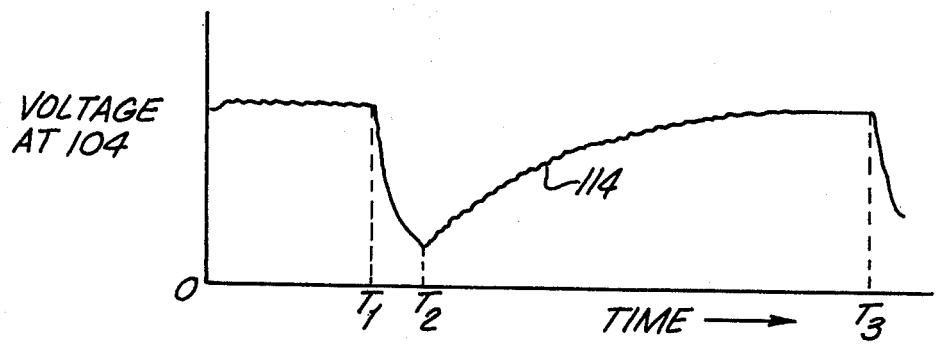
FIG. 4*a* is a time graph of a voltage at a pulse load terminal of a power supply in the running time indicator.

When one of the current pulses into a coil of the stepping motor 22 occurs at the terminals 104, 38, the charge on the capacitors 108, 110 is almost entirely depleted. Thereafter, the charge on these capacitors is built up again gradually during many cycles of generated ac voltage in preparation for the next pulse of stepping motor current. The voltage at the power supply terminals 104, 38 is shown as curve 114 in FIG. 4*a*. A powerful current pulse, whose duty cycle is much less than 30%, occurs from time T1 to time T2. Recovery occurs from time T2 to time T3. The frequency of the ac voltage generated in the coil 14*a* is much higher than the frequency of incremental steps of the stepping motor 22, as controlled by the pulses 74, 76, 78, 80. Shortly after the time T2, the peak output voltage of the generator 14 is relatively low because its current is so high, the capacitors 108, 110 acting almost as a short circuit on the coil 14*a*. Nevertheless, upon each cycle of the voltage generated in the coil 14*a*, the capacitors 108, 110 charge to almost the full peak-to-peak terminal voltage of the coil 14*a*. The output voltage of the generator 14 is low under these conditions because of the heavy current load imposed by the almost completely discharged capacitors 108, 110.

At a later time, shortly before T3 in the recovery interval, the output voltage of the generator coil 14*a* is much higher, because the capacitors 108, 110 are then more fully charged and the generator current is lower, resulting in lower internal impedance drop within the generator coil 14*a*. A relatively low-power generator 14 is sufficient to supply the relatively high-power, but short duty cycle, motor current pulses, because the voltage doubler capacitors 108, 110 collect and store energy during the recovery interval T2 to T3, which is withdrawn from those capacitors during the heavy current interval T1, T2. The capacitors 108, 110 are therefore seen to perform two functions, namely (a) voltage doubling, and (b) slow energy accumulation during many ac cycles of the generator and rapid energy dumping upon current pulse loads.

The power supply 106 has the second output terminal 36 for supplying a relatively uniform current to electronic loads other than the motor, including, for example, the oscillator 30 of the running time indicator. These relatively steady current loads, which are connected between the positive terminal 36 and the common negative terminal 38, must be supplied with a voltage not lss than a predetermined level, typically 3 volts, for proper operation of the circuits. The power supply output voltage at the terminals 36, 38 is sufficient to operate the oscillator 30 and the other electronic circuits when the speed of the engine 12 is above a threshold speed of about half the idling speed of the engine.

Figure 4B:
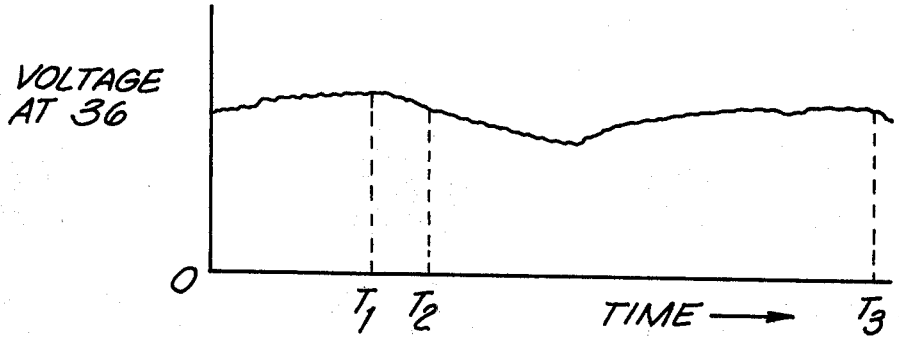
FIG. 4*b* shows a voltage at a second load terminal of the power supply as a function of time.
Figure 5:
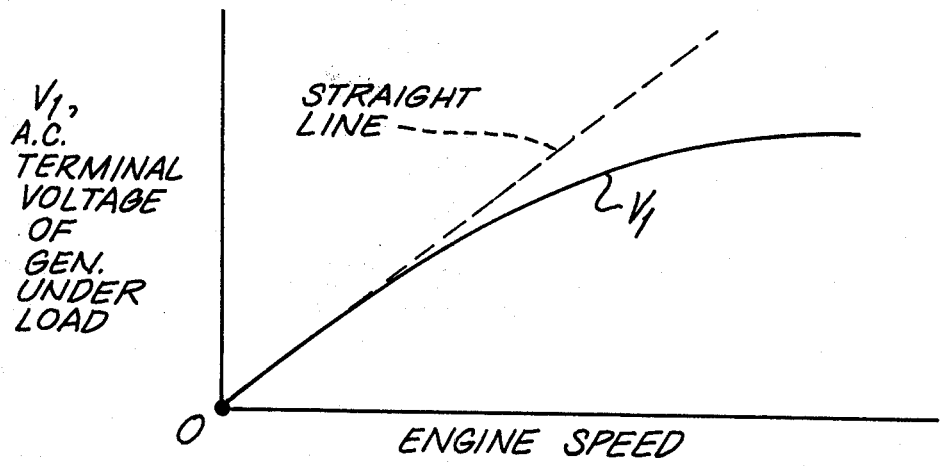
FIG. 5 illustrates how the terminal voltage of an ac generator of the power supply is affected by the speed of the generator.

The oscillator 30 and the other electronic circuits associated with it could not operate properly if they were subjected to the very great decreases of voltage that are present at the terminal 104 when a pulse motor load occurs. The terminal 36 is therefore isolated from the terminal 104 by a diode 120, through which current flows from the terminal 104 to the terminal 36 at times when the voltage at the terminal 104 is relatively high. A capacitor 118 connected from the terminal 36 to the terminal 38 stores energy for use by the oscillator 30 and the logic circuits when the voltage of the terminal 104 is so low that the diode 120 is not conducting. FIG. 4*b* shows a voltage waveform 115 existing between the second output terminal 38 and the common terminal 36.

The ac generator 14 is employed instead of a dc generator in order to prevent the voltages at the output terminals 104 and 36 from varying to the same extent as the speed of the generator 14 varies. At high engine speeds, and therefore high generator speeds, the frequency of ac voltage generated in the coil 14*a* is relatively high. The reactive voltage drop in the coil 14*a* is proportional to this frequency. Consequently, the reactive voltage drop due to current through the inductance of the coil 14*a* is higher at high speeds than at low speeds, for equal amounts of current. When the engine speed varies, terminal voltage of the ac generator does not vary as much as would the terminal voltage of a dc generator. As a result, it is not necessary to employ a voltage regulator on the voltage supply at the terminal 36 (or it is not necessary to employ as good a voltage regulator).

An auxiliary output signal is provided by the running time indicator 10, which is used to operate the optional speed indicator 28, FIG. 1. In the preferred embodiment, the speed indicator 28 receives its operating power from a source other than the generator 14. Although the speed indicator 20 is not a part of the present invention, a signal whose frequency is proportional to the speed of the engine 12 is provided at an auxiliary signal output terminal 20*a* for purposes of operating an optional speed indicator.

Providing such an auxiliary signal output terminal by prior art techniques would expose the high security running time indicator 10 to a risk of damage. An unintentional short circuit could occur from the auxiliary signal output terminal 20*a* to ground, or a short circuit could be applied there intentionally in an effort to incapacitate the running time indicator and prevent the expiration of a time for which the engine is under warranty. Voltages from external sources could also be applied to the terminal 20*a* accidentally, or intentionally in an effort to damage the running time indicator.

Accordingly, a special circuit 122 is employed to convey an alternating signal voltage from the ac generator 14 to the auxiliary output terminal 20*a*, the special circuit being resitant to tampering and accidental improper connections at that terminal. A periodic signal is conducted from one end of the generator coil 14*a* through a series resistor 124 to the base of a common-emitter amplifying transistor 126. An amplified signal from the collector electrode of the transistor 126 is connected to an input terminal of a metal oxide silicon (MOS) buffer circuit which includes two symmetrically connected field effect transistors (FET), each having a gate supplied with that amplified signal.

The output electrodes of the two FETs 128 and 130 are connected at junction 131 as shown in FIG. 2 to two diodes 132, 134, and the junction 131 of those diodes is also connected to one end of a resistor 136 having a resistance preferably exceeding 100,000 ohms. In the embodiment being described, the resistance is of 1 megohm. The other end of the resistor 136 is the auxiliary signal output terminal 20*a* for speed indication. The diode 132 is connected to conduct from the junction 131 to the second positive power supply voltage terminal 36, and the diode 134 is connected to conduct from its anode at the common negative power supply terminal 38 to the junction 131. When the auxiliary output terminal 20*a* is short circuited to ground, a current flow that results through the resistor 136 is almost zero because of a low voltage at junction 131 and the high resistance of the resistor 36. When a positive voltage, for example, +10o volts, is applied to the terminal 20*a*, a current of about 100 microamperes flows from the terminal 20*a* through the resistor 136 and through the diode 132 to the terminal 116; this amount of current is not great enough to damage the apparatus, and the resulting voltage at the junction 131 is too small to damage the apparatus. Similarly, when a negative voltage of −100 volts is applied to the terminal 20*a*, a current of about 100 microamperes flows from the negative supply terminal 38 through the diode 134 and the resistor 136 to the auxiliary output terminal 20*a*, and this current is not sufficient to damage the apparatus. Thus the protection circuit involving the diodes 132, 134 and the resistor 136 not only resists damage to the running time indicator portions of the apparatus, but also resists damage to the buffer circuit 122 itself through which the speed indication signal is provided the terminal 20*a*. Tampering is therefore not likely to be successful.

Although the invention has necessarily been described by describing a preferred embodiment, other embodiments within the scope of the invention are readily apparent in the light of the teaching herein, and they are intended to be encompassed by the present disclosure. For example, instead of using the transistors 95, 96, 97 and 102 to switch the direction of current flow through the coil 82 of the stepping motor 22, the coil 82 could be center-tapped with a common negative lead, and the direction of magnetomotive force produced by the coil could be reversed by connecting a positive current selectively to one or the other of the extreme terminals of the tapped coil.

We claim:

1. A running-time indicator for use with an engine comprising generator means driven by said engine for generating electric power above and below a threshold power level when the speed of said engine is respectively above and below a predetermined speed, and electronic clock means including means for measuring time that elapses only while said generated electric power is above said threshold power level, said electronic clock means being electrically powered solely by said generator means.

2. A running-time indicator as defined in claim 1 and wherein said electronic clock means includes means for generating a periodic signal of substantially constant frequency, and means receiving said periodic signal and responsive to the number of elapsed cycles thereof for indicating a quantity proportional to said number of elapsed cycles.

3. A running-time indicator as defined in claim 2 and wherein said means for generating a periodic signal comprises oscillator means having feedback means for sustaining oscillation of said oscillator means and including ceramic resonator means for establishing said substantially constant frequency.

4. A running-time indicator as defined in claim 1, and wherein said engine has an idling speed and wherein said generator means comprises means for generating sufficient electric power that said threshold power level is achieved at an engine speed less than said idling speed.

5. A running-time indicator as defined in claim 1, and wherein said generator means comprises ac generator means for generating ac voltage of a frequency proportional to the instantaneous speed of said engine, the amplitude of the internally generated voltage of said ac generator means increasing with increases in the speed of said engine, and wherein said ac generator means comprises armature coil means having internal inductance and an internal voltage drop thereacross that varies in proportion to said frequency, and wherein said generator means further comprises rectifier means connected for receiving and rectifying ac terminal voltage from said ac generator means for supplying dc voltage to electrically power said clock means, whereby, in consequence of said variable ac voltage drop across said internal inductance, said dc voltage applied to said clock means varies less than proportionately to the speed of said engine.

6. A running-time indicator as defined in claim 1 and further comprising auxiliary speed circuit means connected with said generator means and having a junction point for providing a speed-indicating signal having a characteristic dependent upon the speed of said engine, a current sink having a sink terminal, at least one switching means connected from said junction point to said current sink terminal and adapted to be rendered conductive for diverting current away from said auxiliary speed circuit means to said current sink terminal, and impedance means for conducting said speed-indicating signal from said junction point to an output terminal and having impedance substantially greater than the conductive impedance of said switching means, said switching means comprising means responsive to be rendered conductive upon external application of a voltage to said output terminal, whereby when such an external voltage is applied current flows from said output terminal through said conductive impedance and said switching means to said current sink terminal to substantially prevent damage to said running time indicator.

7. A running-time indicator as defined in claim 6 and wherein said generator means comprises an ac generator and wherein said signal characteristic is the frequency of said speed-indicating signal.

8. A running-time indicator as defined in claim 6 and wherein said current sink comprises dc voltage supply means providing an electrical potential at said current sink terminal, and wherein said switching means comprises a semiconductor diode connected from said junction point to said current sink terminal and biased for non-conduction in the absence of said external voltage.

9. A running-time indicator for use with an engine comprising electronic clock means for measuring and registering time when the engine is running, said clock means including means responsive to periodic current pulses for registering time, generator circuit means operatively coupled with said engine for supplying said current pulses to said clock means, said generator circuit means including a generator and first capacitance means for accumulating sufficient generated voltage incrementally to provide said current pulses, whereby said generator means supplies said current pulses although said generator means be sized only for providing power at a level lower than the power level of said pulses.

10. A running-time indicator as defined in claim 9 and wherein said clock means further includes time measuring means separate from said pulse responsive means and responsive to a predetermined minimum dc voltage for measuring time, and wherein said clock means for registering comprises means responsive to current pulses sufficient to reduce the voltage of said first capacitance means to a level substantially below said predetermined minimum voltage upon each of said current pulses, and wherein said generator circuit means further comprises switching means for conducting current from said first capacitance means to said time measuring means, said switching means comprising means responsive to the voltage on said capacitance means to conduct when said voltage of said capacitance means exceeds said predetermined minimum voltage, and wherein said generator circuit means further comprises additional capacitance means receiving said current from said switching means for storing energy to be used by said time measuring means when said voltage of said first capacitance means is below said predetermined minimum voltage.

11. A running-time indicator as defined in claim 10 and wherein said switching means comprises rectifier means poled to conduct rectified current from said first capacitance means to said additional capacitance means when the voltage of said first capacitance means exceeds the voltage of said additional capacitance means.

12. A running-time indicator as defined in claim 9 and wherein said electronic clock means comprises means for producing a periodic time signal having substantially constant frequency, mechanical display means having a movable input member responsive to cumulative motion of said input member for producing a display, and wherein said time registering portion of said clock means comprises stepping motor means coupled with said movable input member of said display means and includes a stepping motor having a plurality of electromagnetic coils connected so as to move said input member a fixed incremental step upon receipt of each of said current pulses.

13. A running-time indicator as defined in claim 12 and further comprising means for directing individual cycles of said periodic time signal in succession to energize in turn different coils of said plurality of coils with said pulses of current to effect said steps of said stepping motor.

14. A running-time indicator as defined in claim 12 and wherein said electronic clock means further comprises multiplexing means having a plurality of outputs for distributing contiguously successive clock signals to respective ones of said multiplexer outputs, and switching means controlled by said clock signals received from said multiplexing means for operatively connecting each of said coils to said generator circuit means in a predetermined order and polarity to provide said current pulses, said switching means including means for successively connecting each of said coils with one polarity and thereafter successively connecting same with the opposite polarity to said generator circuit means.

15. A running-time indicator as defined in claim 12 and wherein said electronic generator means comprises ac dynamo means coupled with said engine for generating cyclical voltage when said engine is running, said dc dynamo means comprising means for producing said cyclical voltage at a frequency such that a plurality of cycles of said ac voltage are produced between successive ones of said current pulses, said generator circuit means further comprising voltage doubler circuit means connected with said ac dynamo means for producing a uni-polar output voltage approaching the peak-to-peak voltage of said ac dynamo means and connected to utilize said first capacitance means for voltage doubling, said first capacitance means being connected essentially in parallel with said registering means for supplying said current pulses thereto, whereby said first capacitance means serves both for doubling voltage and for accumulating sufficient energy in increments from said plurality of generated voltage cycles to deliver said current pulses to drive said registering means.

16. A method for indicating the running time of an engine comprising the steps of generating an ac voltage in a generator connected with said engine, doubling said voltage to produce a uni-polar output voltage by charging two capacitance means on successive half cycles of said ac voltage and adding the voltages of the two capacitance means in series, periodically discharging said two capacitance means by supplying periodic current pulses therefrom to drive a time register, and charging said capacitance means cumulatively in increments by a plurality of said ac voltage cycles of said generator between successive discharges by said current pulses, whereby said capacitance means serves both (a) for voltage doubling and (b) for accumulating sufficient energy from said plurality of generated voltage cycles to deliver said current pulses to drive said time register.

17. A method for indicating the running time of an engine as defined in claim 16 and wherein said step of periodically discharging said two capacitance means comprises the steps of generating a periodic electrical signal defining uniform time intervals, utilizing said periodic electric signal to energize a stepping motor, and driving said register by means of said stepping motor.

* * * * *

UNITED STATES PATENT AND TRADEMARK OFFICE

CERTIFICATE OF CORRECTION

PATENT NO. : 3,965,669

DATED : 6/29/76

INVENTOR(S) : Gerald L. Larson; Roger F. Kuether

It is certified that error appears in the above-identified patent and that said Letters Patent are hereby corrected as shown below:

| | |
|---|---|
| Col. 1, line 68: | "As" should read "An". |
| Col. 2, line 30: | "runnin" should read "running". |
| line 32: | "ar" should read "are". |
| line 37: | "to" should read "the". |
| Col. 6, line 27: | "lss" should read "less". |
| Col. 7, line 22: | "resitant" should read "resistant". |
| line 50: | "+10o" should read "+100". |
| line 67: | Add "to" after "provided". |
| Col. 10, line39: | "dc" should read "ac". |

Signed and Sealed this

Twenty-first Day of September 1976

[SEAL]

*Attest:*

RUTH C. MASON
*Attesting Officer*

C. MARSHALL DANN
*Commissioner of Patents and Trademarks*